United States Patent [19]

Altman

[11] 4,263,640

[45] Apr. 21, 1981

[54] LIGHTING DEVICE

[75] Inventor: Peter W. Altman, Philadelphia, Pa.

[73] Assignee: Light & Sound Specialties, Inc., Philadelphia, Pa.

[21] Appl. No.: 855,634

[22] Filed: Nov. 29, 1977

[51] Int. Cl.[3] ..... F21P 5/00; F21P 5/02

[52] U.S. Cl. ..... 362/252; 362/227

[58] Field of Search ..... 362/249, 84, 252, 237, 362/238, 244, 246, 251, 252, 227; 40/442, 444, 902; 340/74

[56] References Cited

U.S. PATENT DOCUMENTS

| | | | |
|---|---|---|---|
| 1,346,493 | 7/1920 | Hammond et al. | 40/442 |
| 1,913,504 | 6/1933 | Nachumsohn | 315/211 |
| 2,713,629 | 7/1955 | Etzkorn | 362/84 |
| 2,825,040 | 2/1958 | Dorsey | 313/318 |
| 3,633,023 | 1/1972 | Castiglioni | 362/249 |
| 3,714,414 | 1/1973 | Sternius | 362/249 |
| 3,715,822 | 2/1973 | Hansen | 40/442 |
| 3,755,663 | 8/1973 | George | 362/249 |
| 3,968,398 | 7/1976 | Lehmann | 362/806 |

*Primary Examiner*—Samuel W. Engle
*Assistant Examiner*—Edward F. Miles
*Attorney, Agent, or Firm*—Seidel, Gonda, Goldhammer & Panitch

[57] ABSTRACT

A lighting device for producing a chasing light effect. A star connected network having three or more conductors, three or more flexible branches, and a common is disposed within a transparent tube. Each of the branches is provided with at least one miniature light source connected to the common. A coupler is secured at one end to the transparent tube and at the other end to a multiple wire cable connected to a sequencer. The multiple wire cable and the star connected network are electrically connected within the coupler. The sequencer excites the network branches in a predetermined sequence.

10 Claims, 6 Drawing Figures e
32
26
28
30
24
a
d
34
b
c
40
36
24
38
COMMON 14
50
COMMON
34
40
36
38
52
54
COMMON
46
48
20
44
COMMON

28
COMMON
30
26
32
14'
55
46'
14
28
32
26
30
COMMON

LIGHTING DEVICE

BACKGROUND OF THE INVENTION

The present invention is directed to a lighting device which produces a chasing light effect. By chasing light effect is meant the optical illusion of moving light in a string or cascade of light sources. This type of light display produces a dynamic sensation and is particularly useful as background lighting in discotheques, restaurants and other places of entertainment. The invention may also be used in public places to indicate direction. In each application, the lighting device can be molded or flexed to the desired functional or ornamental shape.

The invention comprises one or more flexible transparent tubes which house a star connected network of miniature light sources. The light sources are disposed in a string array. A sequencer drives the star connected network to produce the chasing light effect. The transparent tubes are connected by means of a flexible coupler secured at opposite ends to adjacent tubes. No pin connectors or other relatively expensive electrical connector assemblies are required.

Heretofore, lighting devices using flexible transparent tubing were known. For example, see U.S. Pat. Nos. 3,755,663, 2,713,629 and 3,714,414. The use of miniature incandescent light bulbs in a string array was also known. See U.S. Pat. No. 2,825,040.

None of those devices is capable of producing a chasing light effect. Those devices which employ transparent tubing require miniature light bulbs having no bases or sockets. The light sources are connected in parallel between a single pair of conductors disposed within the tubing. For example, see U.S. Pat. Nos. 3,755,663 and 2,713,629. The use of only a pair of conductors facilitates the placement of the bulbs inside the tubing. In addition, it permits the connection of the network of light bulbs to conventional two-wire transformers or other supply devices. The use of a single pair of conductors also enables the tubing to be assembled in a cascade by means of male and female two-pin connectors.

The parallel connection of light sources between a single pair of conductors severely limits the light effects which may be obtained from the lighting device. Assuming no defective light sources, all light sources must be on or off at any instant of time. Thus, the prior art connections do not produce other than static light conditions. The light sources cannot be operated in a predetermined sequence to produce a dynamic or chasing lighting effect.

The present invention comprises a star connected network of miniature light sources using three or more conductors. An advantage of the invention is that it produces a dynamic or chasing light effect.

A further advantage of the invention is that the flexible transparent tubes can be cascaded using a simple flexible coupler.

A further advantage of the invention is that it obviates using male and female pin connectors or similar components to cascade the tubes.

Further advantages of the invention appear hereinafter.

BRIEF SUMMARY OF THE INVENTION

A lighting device for producing a chasing light effect. A first star connected network is disposed within a first transparent tube. The star connected network has three or more conductors, three or more flexible branches, and a common. Each branch is provided with at least one miniature light source connected to the common. Each conductor is connected to no more than one of the branches. Connecting means electrically connects the first network to a sequencer for exciting the network branches in a predetermined sequence. A first coupler is secured at one end to the tube and at the other end to the connecting means. The connecting means and the first network are electrically connected within the first coupler. A second coupler can be secured at one end to the first tube and at the other end to a second transparent tube.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
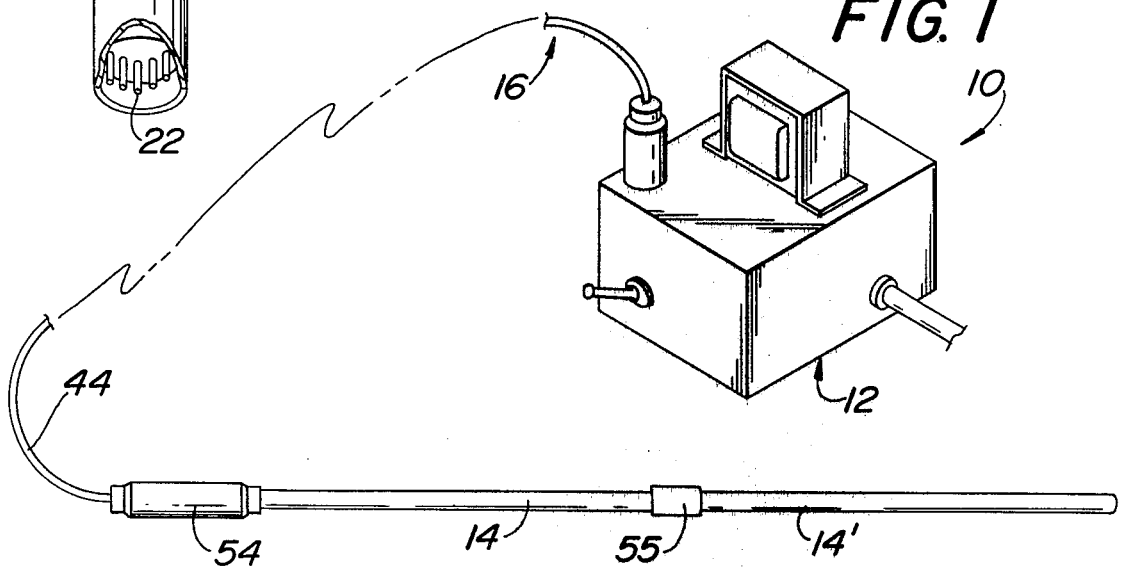
FIG. 1 is an isometric of the sequencer, connecting means, coupler and transparent tube.

Referring to the drawings in detail, wherein like numerals indicate like elements, there is shown in FIG. 1 a lighting device 10 for producing a chasing light effect. A sequencer or sequence timer 12 connected to standard 120 volt, 60 hz line terminals has three or more parallel voltage output terminals (not shown). The output terminals are excited in sequence with a 24 volt signal. At any given instant of time, one and only one output line carries the 24 volt signal, the other lines remaining unexcited.

The invention is not directed per se to the sequencer 12. The sequencer is of conventional design and includes a step down transformer, ac/dc converter, and triac bank for driving the output terminals. The sequencer 10 performs a sequential timing or polling function as will be apparent hereinafter.

Figure 2:
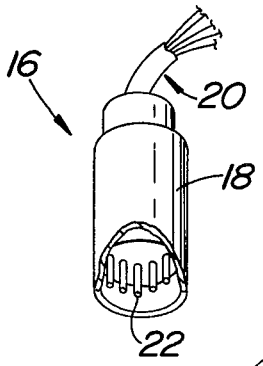
FIG. 2 is a cut-away of a standard pin connector and the multiple wire cable.

The sequencer output terminals are electrically coupled to a flexible light transmissive or transparent tube 14 via connecting means 16. See FIG. 1. Connecting means 16 includes a standard multiple pin connector 18 and multiple wire cable 20. See FIG. 2. The connector 18 has three or more pins 22 for connection to the sequencer output terminals.

Connector pins 22 are electrically connected to the output terminals of sequencer 12 in a conventional pin and socket arrangement. One of the pins 22 is connected to a common or ground terminal at the sequencer.

Transparent tube 14 houses a star connected network 42 of miniature light sources 24. See FIG. 3. Preferably, the light sources 24 are conventional miniature incandescent light bulbs having no bases or sockets. Miniature incandescent light bulbs operated at 4 volts are suitable for this purpose.

The light bulbs 24 are series connected with laminated flexible wire to define four separate flexible branches or legs 26, 28, 30 and 32. Each of the branches is connected to the common. In addition, each of the branches is connected to one of the conductors 34, 36, 38 and 40.

None of the branches 26–32 are connected in parallel. Each branch, then, can be separately excited by the sequencer 12 as indicated by the time wave forms shown in FIG. 3. These wave forms represent the sequence in which the sequencer output terminals are excited. Preferably, at any given instant of time, no more than one output terminal is excited. If desired, however, a certain degree of overlap between wave forms can be tolerated without sacrificing the desired chasing effect. The best effect is obtained with no overlap.

Figure 3:
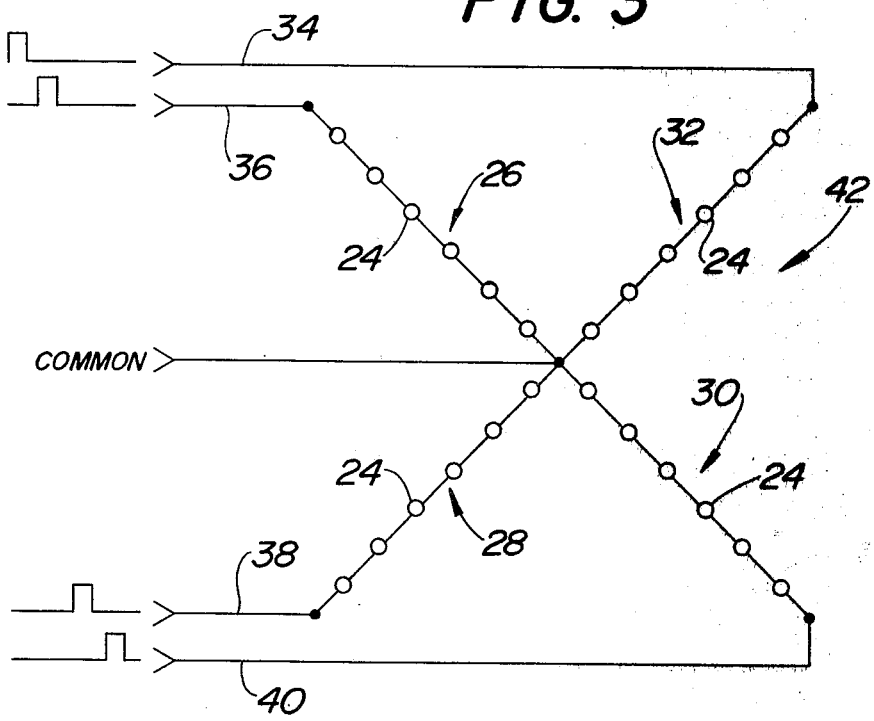
FIG. 3 is an electrical schematic of a star connected network of miniature light sources using four conductors and a common.

If the miniature light sources 24 were spatially configured as shown in FIG. 3, the optical illusion of a rotating pinwheel would be produced in response to the sequencer outputs. Of course, this is not the desired chasing light effect, and the light sources are not spatially configured in this manner. FIG. 3 merely illustrates the electrical interconnections required to form the star connected network 42.

Figure 4:
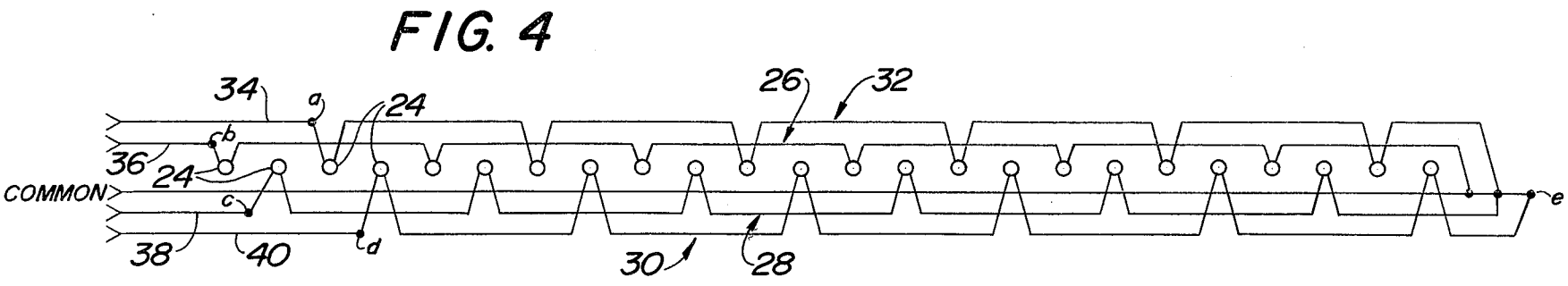
FIG. 4 is an electrical schematic of the star connected network in FIG. 3 showing a preferred spatial arrangement of the light sources.

The preferred spatial configuration of the miniature light sources 24 is shown in FIG. 4. Preferably, each flexible branch 26–32 comprises six identical miniature incandescent light sources 24 in series connection. Since the potential across each branch is approximately 24 volts during excitation, each of the bulbs is operated at approximately 4 volts. Of course, the number of bulbs per branch can be varied to accommodate greater or lesser voltages from the sequencer. For example, if the sequencer voltages are 12 volts, each branch can contain three series connected miniature light sources rated at 4 volts each. The number of bulbs which can be series connected in each branch is given by the quotient of the sequencer output voltage and the voltage at which each light source is to be operated.

The light sources 24 in each of the network branches are interleaved as shown in FIG. 4 to form a string array through one or more transparent tubes. The length of the string array can be varied by varying the number of branches 26–32 and conductors 34–40 in the star connected network. The sequencer output voltage and the number of miniature light sources per branch, and the spacing between light sources can be maintained constant. For example, to double the length of the string array shown in FIG. 4, eight branches and eight conductors can be connected in star configuration. To triple the length of the string, the number of branches and the number of conductors would be tripled, and so forth. The minimum length would correspond to a network comprising three conductors and three branches in star connection to a common.

Alternatively, the number of conductors may be maintained constant and two or more identical networks of branches, each in star configuration, can be connected between the conductors and common to form a single assembly. Like branches of the networks would be connected in parallel between common and one of the conductors.

Figure 5:
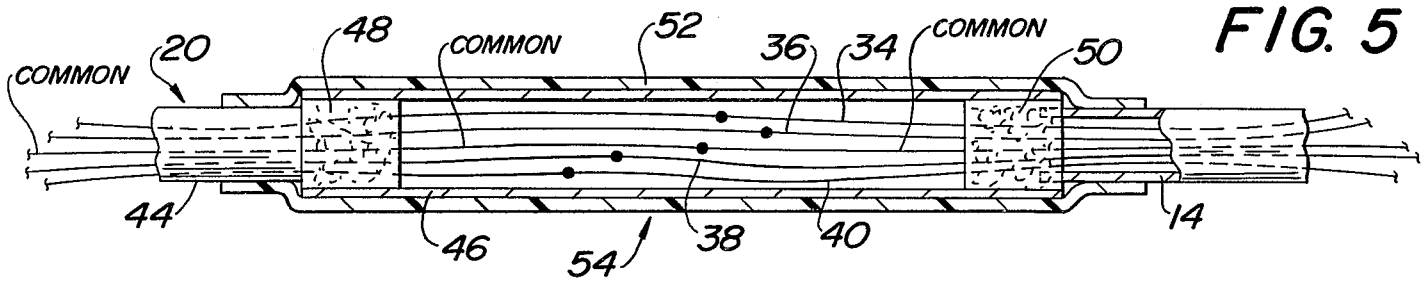
FIG. 5 is a cross-section of a coupler for connecting the multiple wire cable to the star network.

The sequencer output terminals, including common, are connected via conventional multiple wire cable 20 to conductors 34, 36, 38 and 40 and common as shown in FIG. 5. The multiple wire cable and conductors 34–40 may be electrically connected by hand soldering or other suitable technique. Each of the wires and conductors may be laminated with an insulative coating. The multiple wire cable 20 includes a flexible sleeve 44 which terminates at the end of a portion of flexible transparent tubing 46. The sleeve 44 and the cable wires are fixed in position at the end of the tubing 46 in potting 48. The distal end of the tubing 46 surrounds an end of the transparent tube 14. The id of the tubing 46 is approximately the same as or slightly greater than the od of tube 14. The end of the tube 14 and the conductors 34–40 are fixed in position at the distal end of the tubing 46 in potting 50. Conventional heat shrinking material 52 is fitted by well-known technique around the cable 20, tubing 46 and tube 14. The assembly of tubing 46, potting 48 and 50, and heat shrinking material 52 defines a coupler 54.

Figure 6:
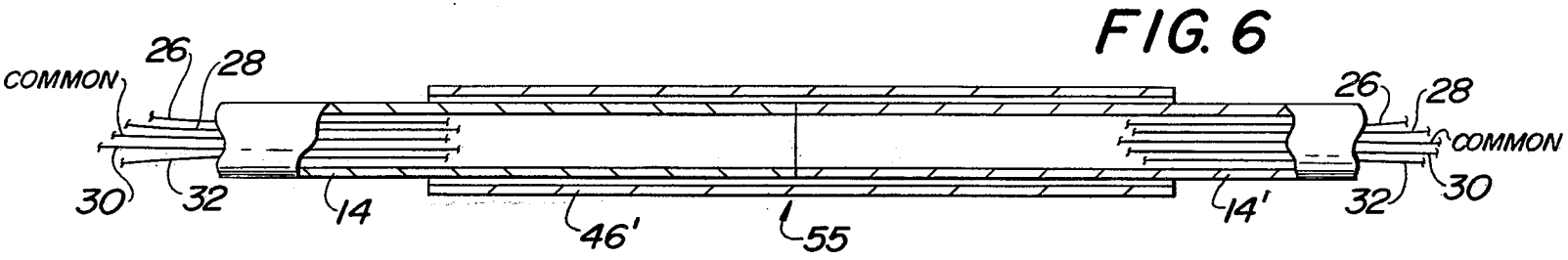
FIG. 6 is a cross-section of a coupler for connecting adjacent transparent tubes.

A coupler 55 may be used to couple flexible transparent tubes 14 and 14' in cascade as shown in FIG. 6. The star connected network of conductors and flexible branches is drawn through both tubes. The ends of the tubes are brought into abutment, and a sleeve of flexible tubing 46' is slipped over both ends. The id of tubing 46' is approximately the same as or slightly greater than the od of tubes 14 and 14'. This enables a tight friction fit to be made at the joint between the tubes. Glue or other suitable adhesive may be applied to the joint between tubes 14 and 14'. If desired, any gap between sleeve 46' and tubes 14 and 14' may be filled with glue or the like to further secure the sleeve in place.

The lighting device is easily assembled. First, the star connected network 42 is formed by connecting three or more conductors to three or more flexible branches, each branch having at least one miniature light source and, preferably, two or more series connected light sources. Each conductor is connected to no more than one branch. All branches are connected to a common. The light sources are interleaved in a string array as shown in FIG. 4. The array is then drawn into position in the flexible transparent tubes 14 and 14'. The tubes are brought into abutment and coupled by means of sleeve 46'. The conductors and common are then connected to the multiple wire cable 20, and the coupler 54 is fastened to the tube and cable.

The invention has been described in terms of the preferred embodiment. That embodiment comprises a star connected network of four branches with six miniature light sources in each branch. Each light source operators at 4 volts. Each branch is excited in sequence by a 24 volt signal from the sequencer. Other voltages and numbers of branches and light bulbs can also be used in practicing the invention. The flexible transparent tube 14 may be made of a polycarbonate material. So may the portion of flexible transparent tubing 46 and 46'. Tubing 46 and 46'should be flexible to permit the lighting device to be molded or flexed into the desired shape.

The present invention may be embodied in other specific forms without departing from the spirit or essential attributes thereof and, accordingly, reference should be made to the appended claims, rather than to the foregoing specification as indicating the scope of the invention.

I claim:

1. A lighting device for producing a chasing light effect, comprising:

a first transparent tube, a star connected network disposed within said first tube, said network having three or more conductors, three or more flexible branches and a common, each of said branches being provided with plural miniature light sources connected to said common, and each of said conductors being connected to no more than one of said branches, said miniature light sources being spatially interleaved in a repetitive arrangement within said first tube such that each miniature light source of each branch is located between and spaced apart from two miniature light sources of two of the other branches, connecting means for electrically connecting said first network to a sequencer for exciting said first network branches in a predetermined sequence, and a first coupler secured at one end to said first transparent tube and at the other end to said connecting means, said connecting means and first network being electrically connected within said first coupler.

2. The lighting device according to claim 1 including a second transparent tube, a second coupler secured at one end to said first transparent tube and at the other end to said second transparent tube, said star connected network being disposed within said first and second transparent tubes.

3. A lighting device for producing a chasing light effect, comprising:

first and second transparent tubes, a star connected network disposed within said first and second transparent tubes, said star connected network having three or more conductors, three or more flexible branches, and a common, each of said branches being provided with plural miniature light sources connected to said common, and each of said conductors being connected to no more than one of said branches, said miniature light sources being spatially interleaved in a repetitive arrangement within said first and second tubes such that each miniature light source of each branch is located between and spaced apart from two miniature light sources of two of the other branches, and a first coupler secured at one end to said first transparent tube and at the other end to said second transparent tube.

4. The lighting device according to claim 3 including:

connecting means for electrically connecting said first network to a sequencer for simultaneously exciting said network branches in a predetermined sequence, and a second coupler secured at one end to said first transparent tube and at the other end to said connecting means, said connecting means and said first network being electrically connected within said second coupler.

5. A lighting device for producing a chasing light effect, comprising:

first and second transparent tubes, first and second star connected networks disposed respectively within said first and second tubes, each of said first and second networks having three or more flexible branches connected to a common junction, each of said branches being provided with plural miniature light sources connected to said common junction, and three or more conductors, each of which connects one branch of one of said networks to one branch of the other of said networks, said miniature light sources being spacially interleaved in a repetitive arrangement within said first and second transparent tubes such that each miniature light source of each branch is located between and spaced apart from two miniature light sources of two of the other branches, connecting means for electrically connecting said conductors to a sequencer for simultaneously exciting said first and second network branches in a predetermined sequence, a first coupler secured at one end to said first transparent tube and at the other end to said connecting means, said connecting means and said first network being electrically connected within said first coupler, and a second coupler secured at one end to said first transparent tube and at the other end to said second transparent tube.

6. The lighting device according to claim 5 wherein said first coupler comprises a sleeve having an inner diameter not less than the outer diameter of said first transparent tube, and a heat shrink member surrounding said sleeve.

7. The lighting device according to claim 5 wherein said second coupler comprises a sleeve having an inner diameter not less than the outer diameter of said first transparent tube and the od of said second transparent tube.

8. A method of producing a chasing light effect, comprising:

connecting three or more conductors to three or more flexible branches, each branch having plural miniature light sources, so that each conductor is connected to no more than one of said branches, connecting each of said branches to a common to produce a star connected network, interleaving said miniature light sources in a repetitive spatial arrangement such that each miniature light source of each branch is located between and spaced apart from two miniature light sources of two of the other branches, inserting said star connected network in at least one transparent tube, securing a coupler to at least one end of said transparent tube and to a multiple wire cable, and connecting said multiple wire cable to said star connected network.

9. The method according to claim 8 including connecting said multiple wire cable to a sequencer for exciting said network branches in a predetermined sequence.

10. The method according to claim 8 including:

inserting said star connected network in two or more transparent tubes, and securing a second coupler to adjacent ends of said transparent tubes.

* * * * *